US010881945B2

(12) United States Patent
Li

(10) Patent No.: US 10,881,945 B2
(45) Date of Patent: Jan. 5, 2021

(54) SKATEBOARD

(71) Applicant: J.D COMPONENTS CO., LTD., Chang Hua Hsien (TW)

(72) Inventor: Ching-Ho Li, Chang Hua Hsien (TW)

(73) Assignee: J.D Components Co., Ltd., Chang Hua Hsien (TW)

( * ) Notice: Subject to any disclaimer, the term of this patent is extended or adjusted under 35 U.S.C. 154(b) by 0 days.

(21) Appl. No.: 16/577,642

(22) Filed: Sep. 20, 2019

(65) Prior Publication Data

US 2020/0155920 A1 May 21, 2020

(30) Foreign Application Priority Data

Nov. 15, 2018 (TW) ..... 107140660 A
Feb. 1, 2019 (TW) ..... 108201739 A

(51) Int. Cl.
*A63C 17/01* (2006.01)
*A63C 17/00* (2006.01)

(52) U.S. Cl.
CPC ..... *A63C 17/012* (2013.01); *A63C 17/0046* (2013.01); *A63C 17/015* (2013.01)

(58) Field of Classification Search
CPC .. A63C 17/012; A63C 17/015; A63C 17/0033
See application file for complete search history.

(56) References Cited

U.S. PATENT DOCUMENTS 4,168,842 A * 9/1979 Kimmell ..... A63C 17/01 280/11.28
4,194,752 A * 3/1980 Tilch ..... A63C 17/01 280/11.28
5,160,155 A * 11/1992 Barachet ..... A63C 17/0033 280/11.209
6,547,262 B1 4/2003 Yamada et al.
6,739,603 B1 * 5/2004 Powell ..... A63C 17/0093 280/11.27
8,465,027 B2 * 6/2013 Burke ..... A63C 17/02 280/11.27
8,807,577 B2 * 8/2014 Lai ..... A63C 17/0046 280/11.28

(Continued)

FOREIGN PATENT DOCUMENTS

WO 03/092831 A1 11/2003

*Primary Examiner* — John D Walters
*Assistant Examiner* — James J Triggs
(74) *Attorney, Agent, or Firm* — Muncy, Geissler, Olds & Lowe, P.C.

(57) ABSTRACT

A skateboard includes a board adapted for a user to stand with both feet thereon and having a major axis, and a front steering device and a rear steering device respectively disposed on front and rear sections of a bottom surface of the board along the major axis and each having two wheels. The front or rear steering device has a wheel seat disposed on the bottom surface of the board rotatably around a rotation axis which inclines downwards from front to rear, and a wheel rack disposed on the wheel seat rotatably or swingably around a main axis. An abutted surface is defined where the wheel seat and the wheel rack are abutted against each other. On an imaginary vertical plane including the major axis, where the rotation axis passes the abutted surface is in front of where the main axis passes the abutted surface.

17 Claims, 16 Drawing Sheets

(56) References Cited

U.S. PATENT DOCUMENTS

| | | | | |
|---|---|---|---|---|
| 10,160,503 | B1 * | 12/2018 | Zheng | A63C 17/017 |
| 2002/0125670 | A1 * | 9/2002 | Stratton | A63C 17/01<br>280/87.041 |
| 2010/0301572 | A1 * | 12/2010 | Newton | A63C 17/12<br>280/11.27 |
| 2012/0140885 | A1 * | 6/2012 | Iwakiri | A61B 6/4291<br>378/62 |

* cited by examiner

SKATEBOARD

BACKGROUND OF THE INVENTION

1. Field of the Invention

The present invention relates to a skateboard and more particularly, to a four-wheeled skateboard which is provided in each of the front and rear thereof with two wheels.

2. Description of the Related Art

The structure of the conventional skateboard, such as the structure disclosed in Patent Publication No. WO 03/092831 A1, includes a front footrest and a rear footrest for a user to apply the weight or feet force thereof to elastically twist and deform the front and rear footrests in opposite directions around a central axis in the front and rear direction, thereby driving the wheels on the bottom surfaces of the footrests to roll forwards. However, the skateboard disclosed in said patent has a single front wheel and a single rear wheel, thereby poor in operational stability. For beginners and the use of the skateboard on roads with bad road conditions, there is liable a risk of accidents.

Therefore, Patent Publication No. U.S. Pat. No. 6,547,262B1 disclosed a skateboard with four wheels, which is improved in operational stability. However, in this patent, the hanger (numbered 7 in said patent) of the yoke (numbered 6 in said patent) of the skateboard is connected and fastened to the board (numbered 1 in said patent) by only the central pin (numbered 10 in said patent), so the wheels (numbered 2 in said patent) have a relatively smaller range of deflecting and pivoting relative to the board (numbered 1 in said patent), thereby still improvable in operational smoothness.

SUMMARY OF THE INVENTION

Therefore, it is an objective of the present invention to provide a skateboard which is effectively improved in operational stability and smoothness, providing the user relatively better experience.

To attain the above objective, the present invention provides a skateboard which includes a board, a front steering device and a rear steering device. The board has a major axis. The front steering device and the rear steering device are respectively disposed on the front and the rear of the bottom surface of the board along the major axis. Each of the front steering device and the rear steering device has two wheels. The board is adapted for a user to stand with both feet on the board. At least one of the front steering device and the rear steering device has a wheel seat and a wheel rack. The wheel seat is disposed on the bottom surface of the board rotatably around a rotation axis which inclines downwards from front to rear. The wheel rack is disposed on the wheel seat rotatably or swingably around a main axis. An abutted surface is defined where the wheel seat and the wheel rack are abutted against each other. On an imaginary vertical plane including the major axis, the position where the rotation axis passes the abutted surface is in front of the position where the main axis passes the abutted surface.

Through the afore-described structure, when the user uses the skateboard, at first the user uses the shifting of the weight thereof or the driving of the force of both feet thereof to make the board twist and deform in opposite directions around the major axis. Because each of the front steering device and the rear steering device has two wheels, the skateboard is relatively better in operational stability. Besides, on the imaginary vertical plane including the major axis, the position where the rotation axis passes the abutted surface is in front of the position where the main axis passes the abutted surface, so the board will firstly transmit the force applied by the user to the wheel seat to drive the wheel seat to rotate relative to the board, and then the wheel seat will further drive the wheel rack to swing or rotate relative to the wheel seat. Because the wheel rack will swing or rotate after the wheel seat is driven to rotate, the force applied by the user will not be counteracted by the wheel rack firstly. In addition, the wheel seat and the wheel rack are both rotatable relative to the board, so the skateboard has relatively better performance in operational smoothness in advancing.

Optionally, the included angle between the rotation axis and a horizontal plane is larger than the included angle between the main axis and the horizontal plane.

Optionally, the angular difference between the included angle between the rotation axis and the horizontal plane and the included angle between the main axis and the horizontal plane is ranged from 15 to 30 degrees.

Optionally, a shock absorber is disposed between the wheel rack and the wheel seat for actuating the wheel rack to rotate or swing relative to the wheel seat.

Besides, the skateboard provided by the present invention not only has the above-mentioned features; in another aspect of the present invention, the skateboard includes a restoring unit. The restoring unit is disposed between the board and the wheel seat for providing the wheel seat a restoring force when the wheel seat rotates relative to the board.

Optionally, the wheel seat includes a top cap and a main body. The main body and the top cap define an accommodating space. The restoring unit is disposed in the accommodating space.

Optionally, the restoring unit includes a spring cover and a restoring spring. The spring cover is fixed to the bottom surface of the board and provided with a stopping portion extending parallel to the rotation axis. The restoring spring has two protruding rods extending perpendicularly to the rotation axis. The stopping portion is located between the two protruding rods.

Optionally, the top cap has a pushing portion extending parallel to the rotation axis. The pushing portion is located between the two protruding rods.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The skateboard provided by the present invention will be further described by the embodiment and the accompanying drawings given herein below, and wherein.

DETAILED DESCRIPTION OF THE INVENTION

First of all, it is to be mentioned that the technical features provided by the present invention are unlimited to the specific structure, usage and application thereof described in the detailed description of the invention. It should be understood by those skilled in the related art that all the terms used in the contents of the specification are for illustrative description. The directional terms mentioned in the contents of the specification, such as 'front', 'on', 'down', 'rear', 'left', 'right', 'top', 'bottom', 'inside', and 'outside', are also just for illustrative description on the basis of normal usage direction, not intended to limit the claimed scope.

Besides, the numeral terms with singular form, such as 'a', 'an' and 'the', used in the claims of the present invention all include the plural meaning. Thus, for example, the description for 'an element' refers to one or a plurality of elements and includes the equivalent replacements known by those skilled in the related art. All conjunctions used in similar conditions should also be understood in the broadest sense. The specific shapes and structural features or technical terms described in the contents of the specification should also be understood to include the equivalently replacing structures or technical terms capable of attaining the function of the specific structures or technical terms.

Referring to FIGS. 1-10, a skateboard 1 of an embodiment of the present invention includes a board 10, a front steering device 20, and a rear steering device 40.

Figure 1:
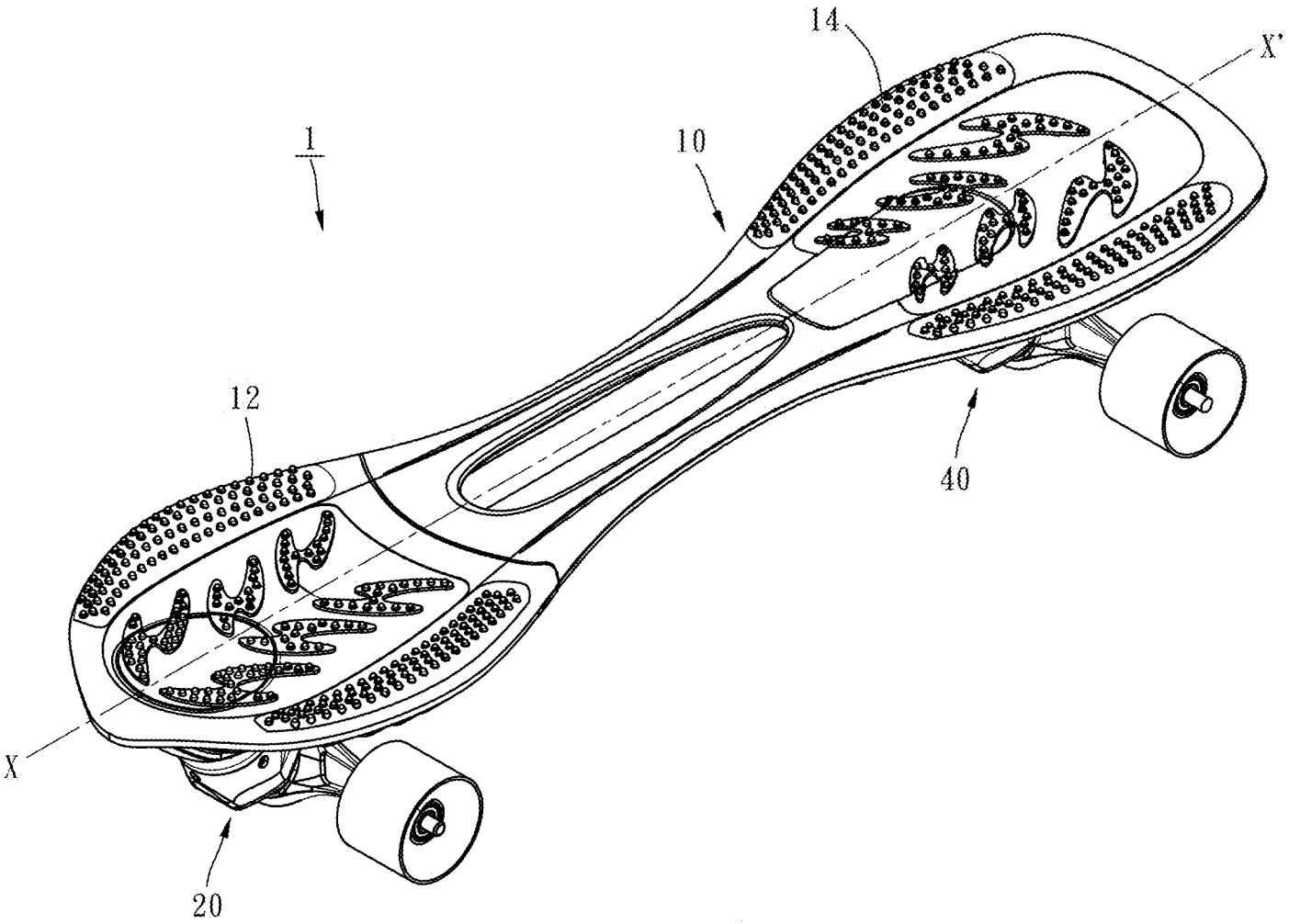
FIG. 1 is a perspective view of a skateboard of an embodiment of the present invention.
Figure 2:
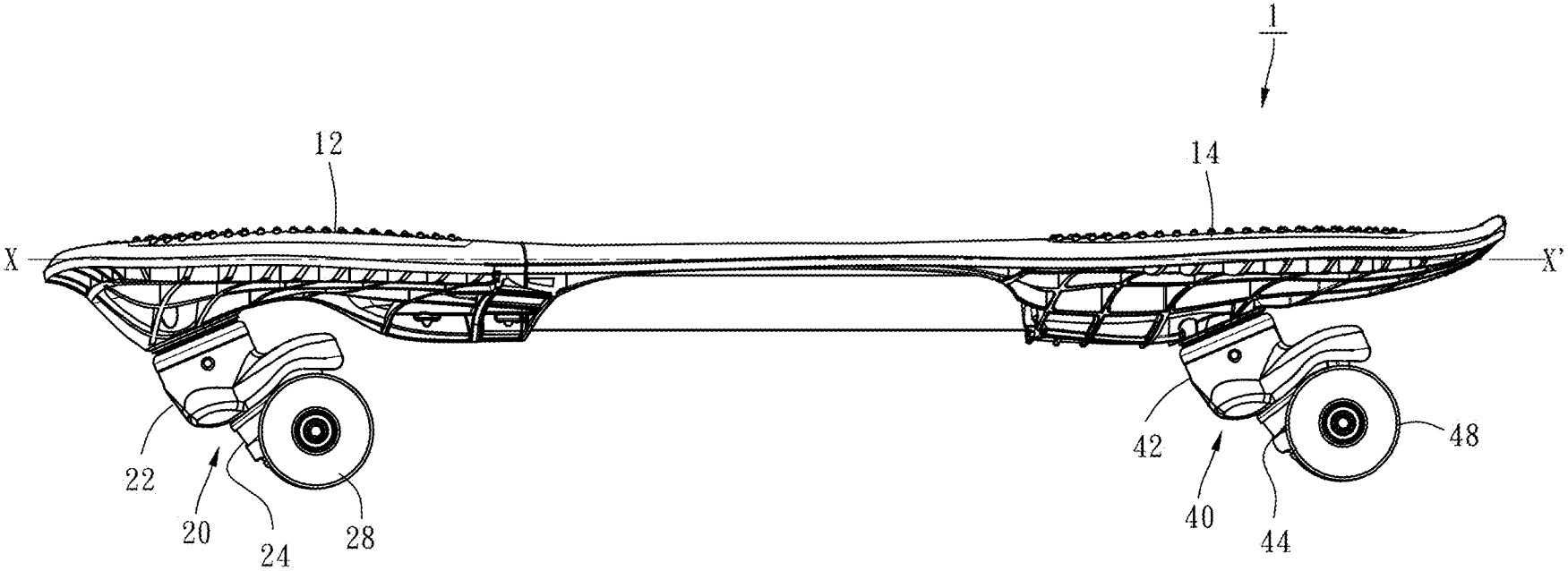
FIG. 2 is a side view of the entire skateboard of the embodiment of the present invention.
Figure 3:
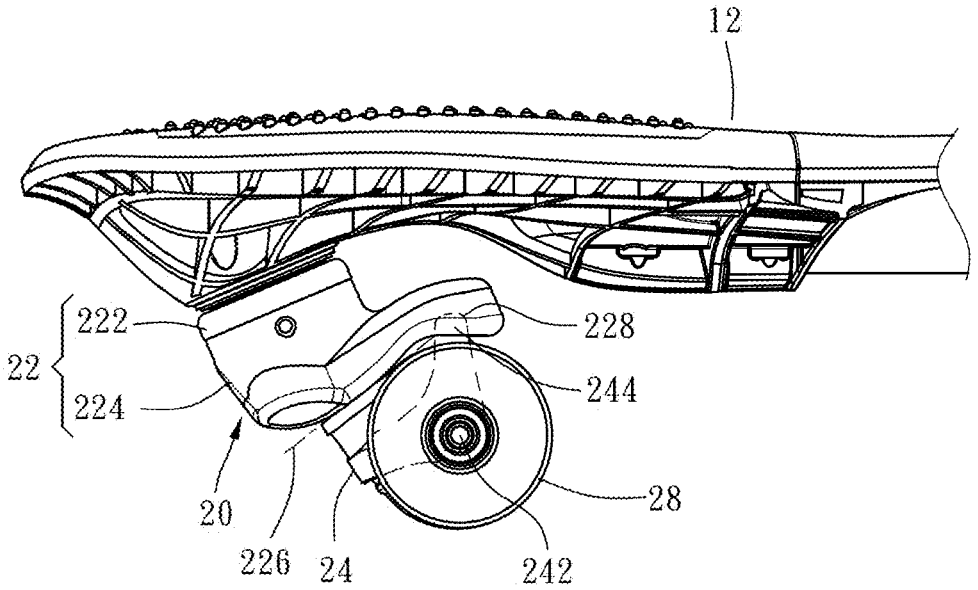
FIG. 3 is a partially enlarged side view of the embodiment of the present invention, primarily showing a front steering device.
Figure 4:
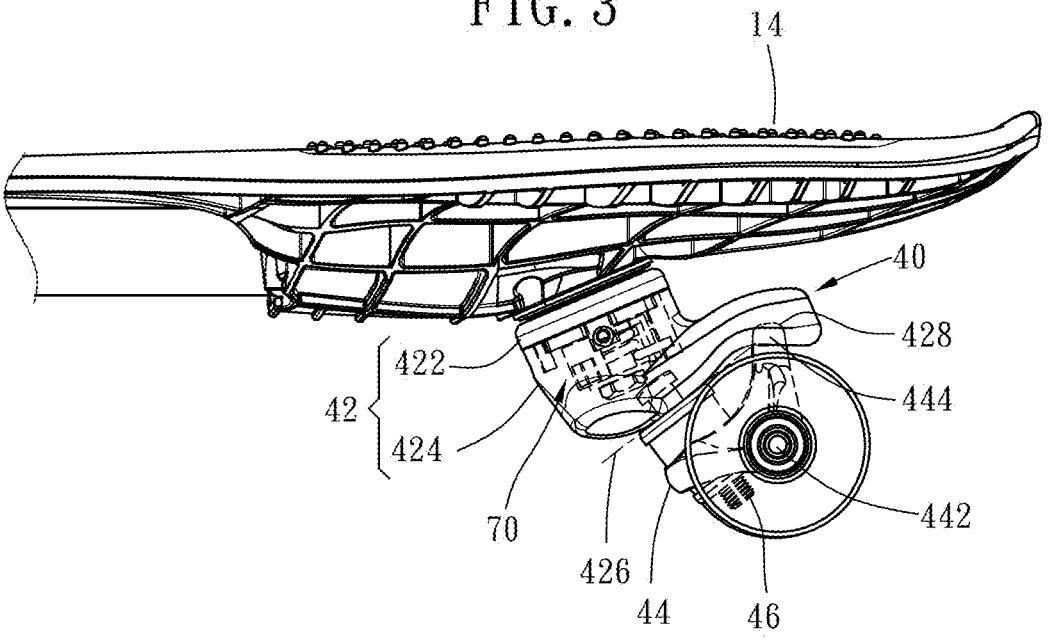
FIG. 4 is a partially enlarged side view of the embodiment of the present invention, primarily showing a rear steering device.
Figure 5:
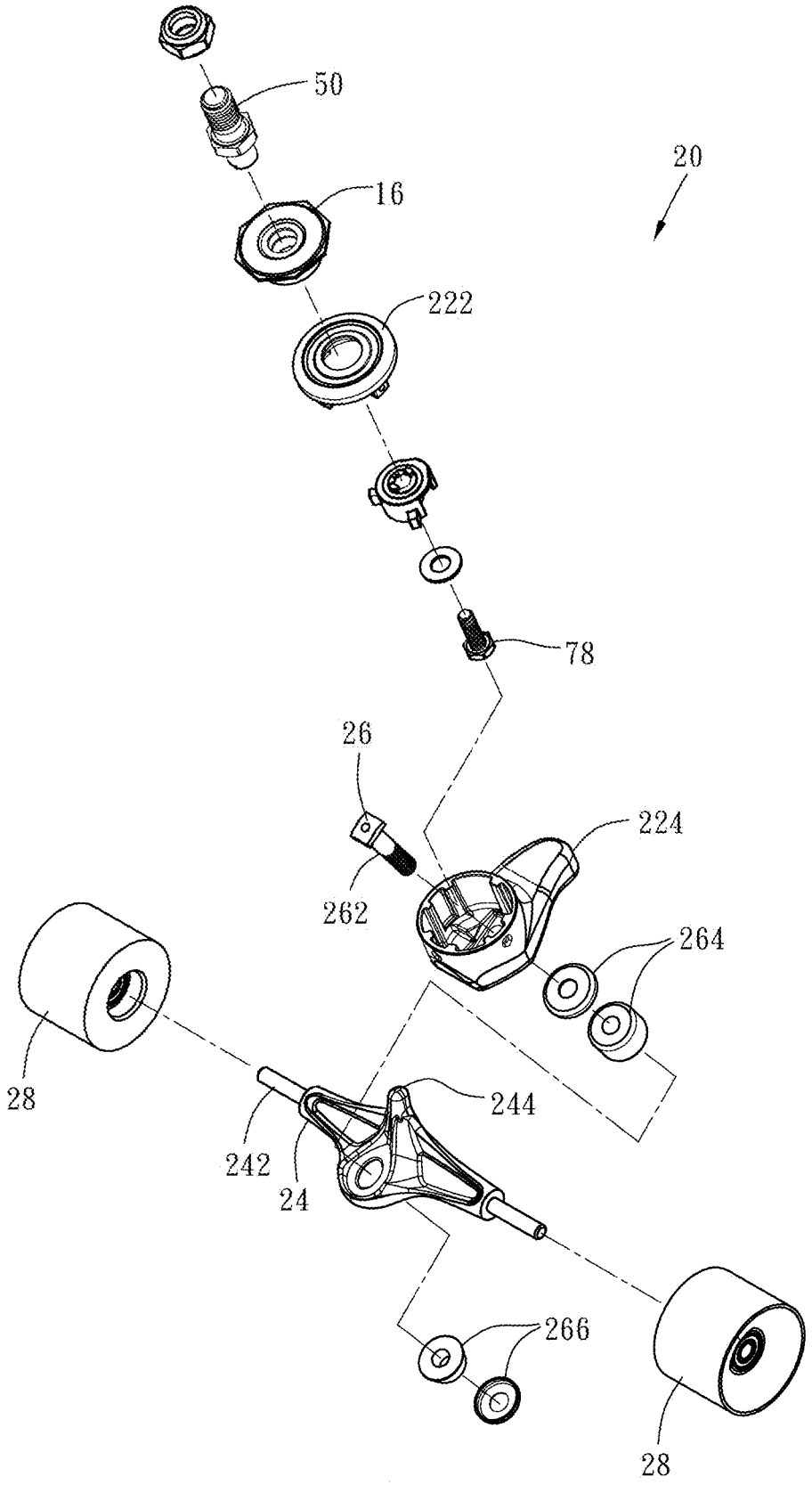
FIG. 5 is an exploded perspective view of the front steering device of the embodiment of the present invention.
Figure 6:
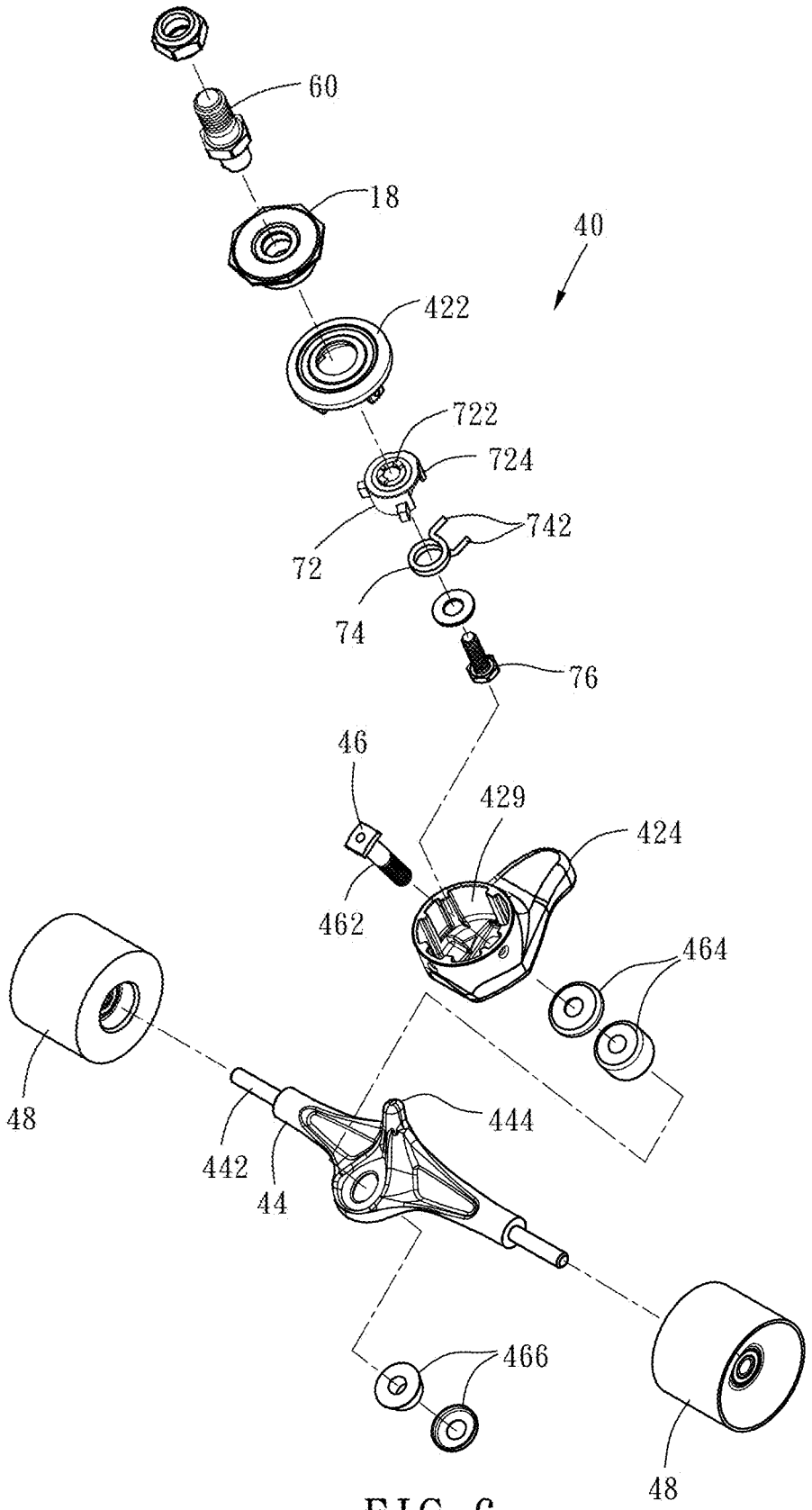
FIG. 6 is an exploded perspective view of the rear steering device of the embodiment of the present invention.
Figure 7:
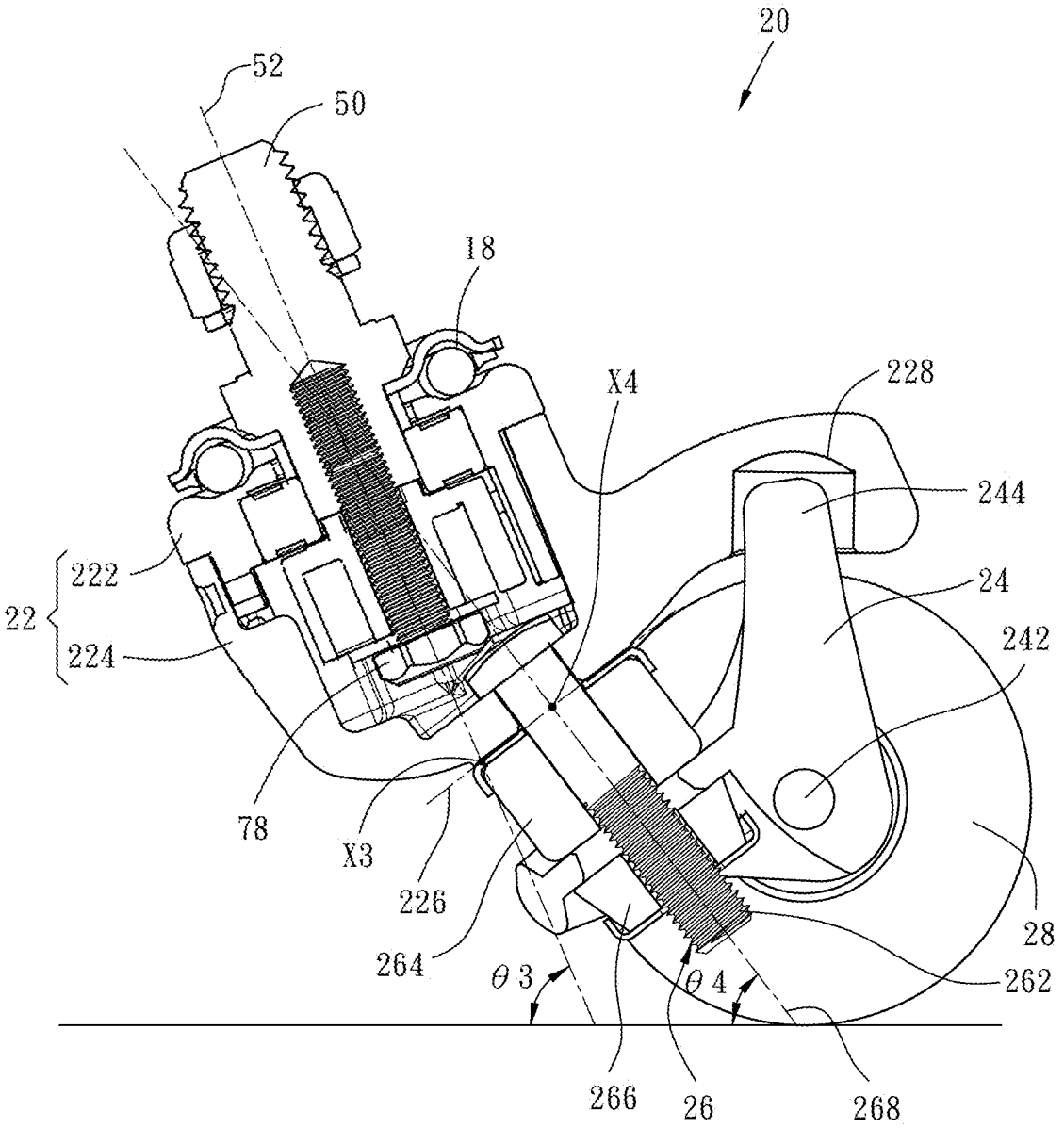
FIG. 7 is a sectional side view of the front steering device of the embodiment of the present invention.
Figure 8:
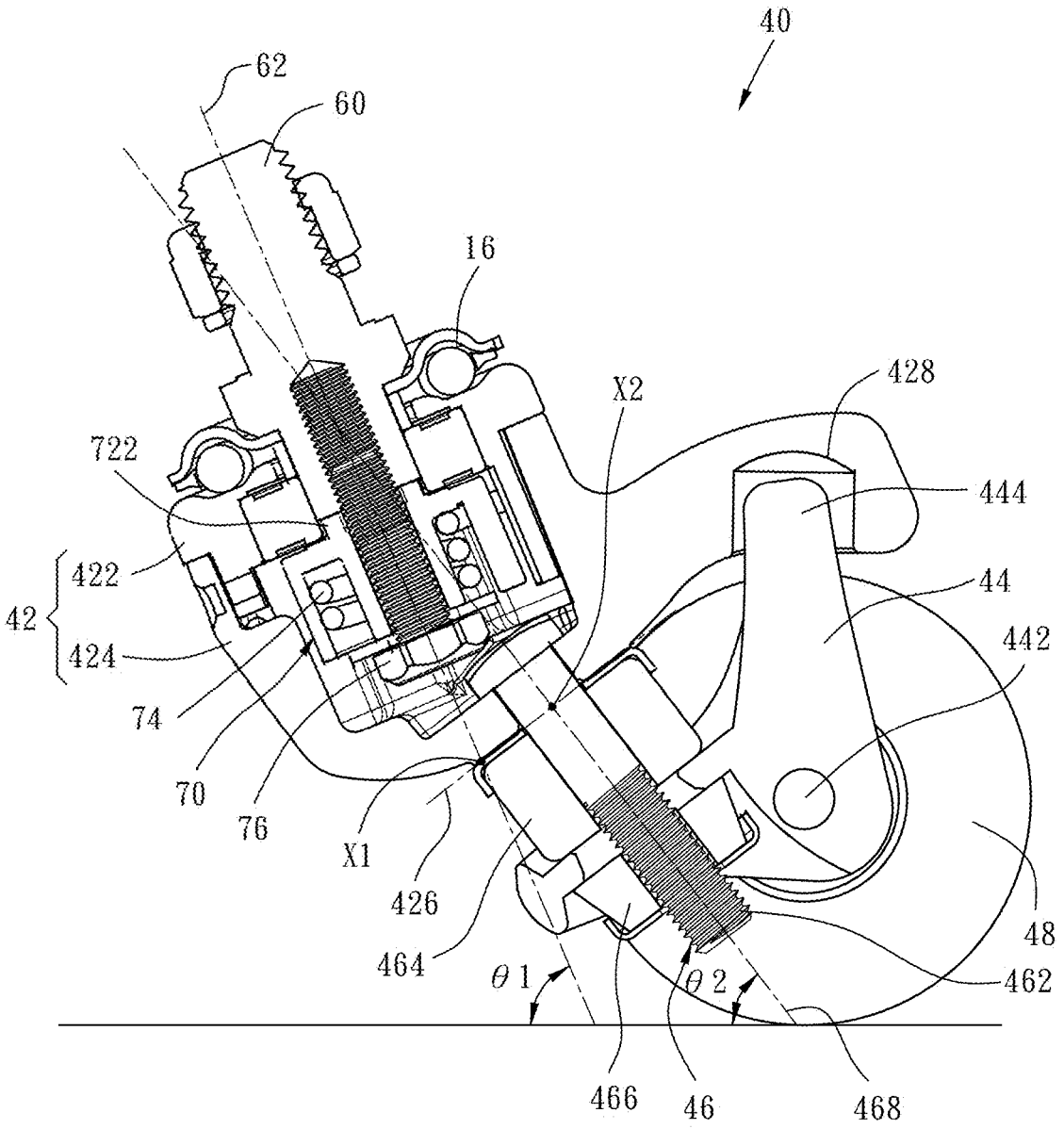
FIG. 8 is a sectional side view of the rear steering device of the embodiment of the present invention.
Figure 9:
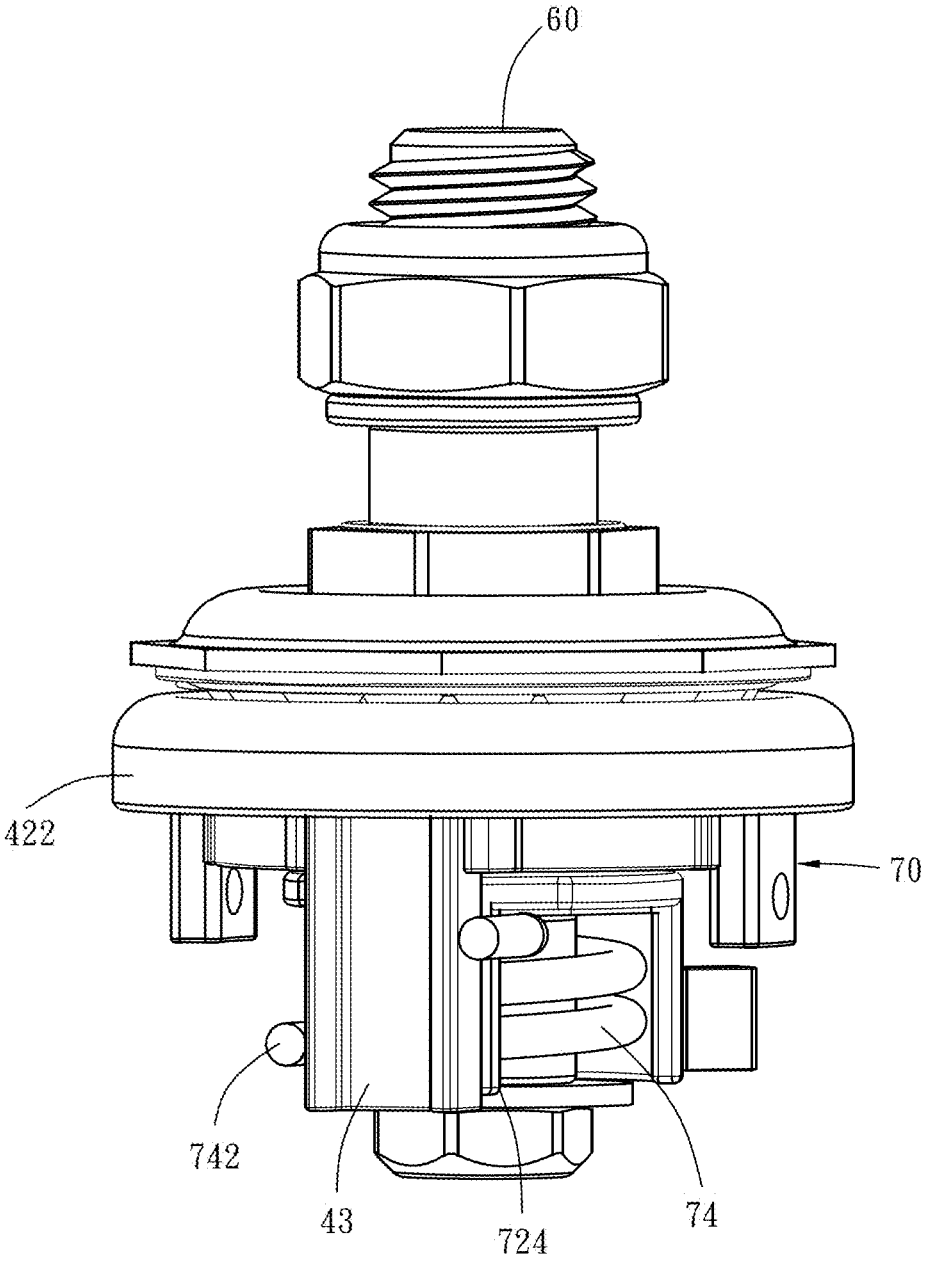
FIG. 9 is an enlarged perspective view of a part of the embodiment of the present invention, primarily showing a restoring unit.
Figure 10:
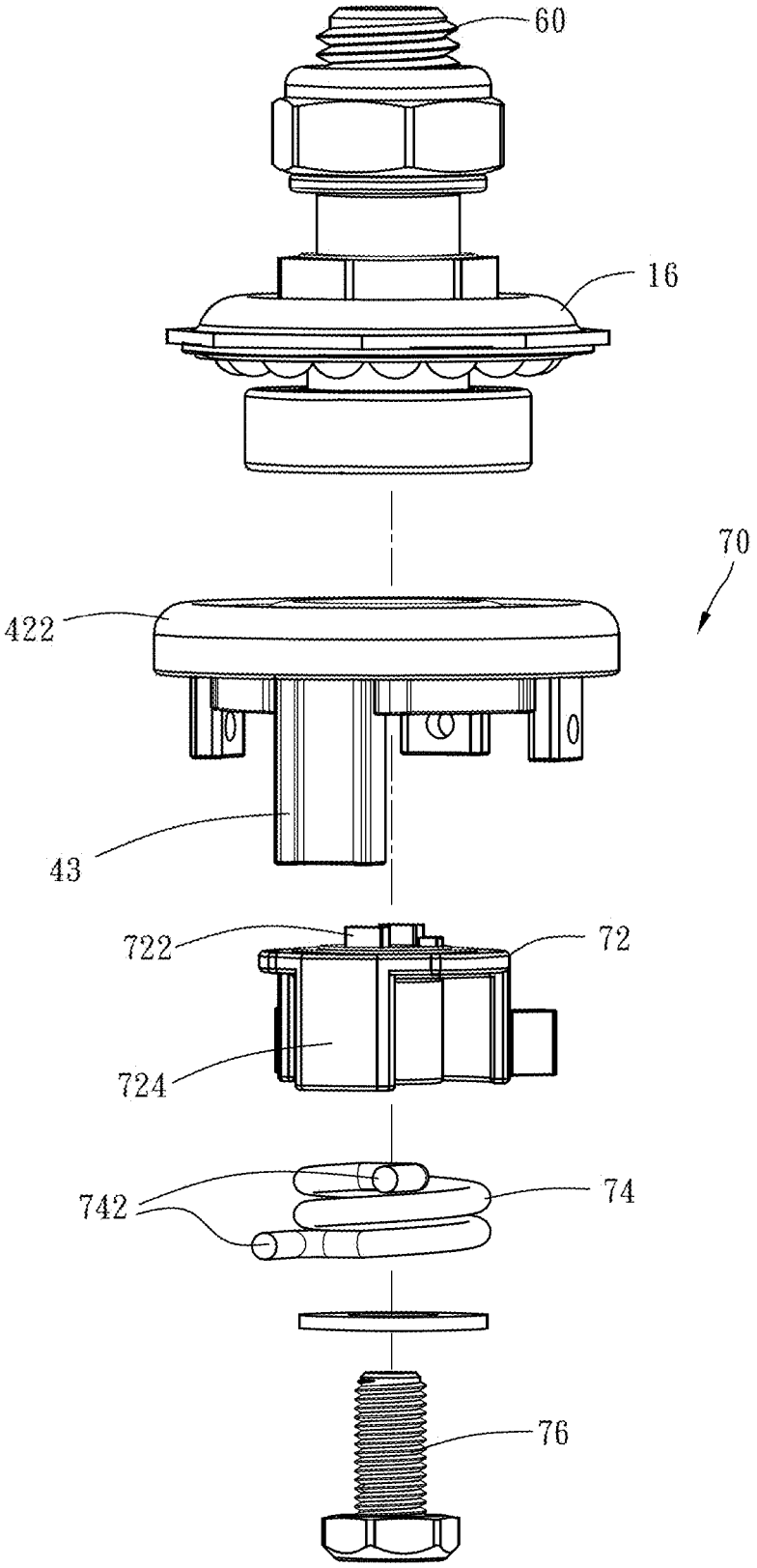
FIG. 10 is an exploded perspective view of the structure showing in FIG. 9.

Referring to FIGS. 1-3, the board 10 is made of elastic material which may be optionally, but unlimited to, resin or composite material mixed with resin. The board 10 is approximately shaped as an elongated board and has a major axis X-X'. In this embodiment, the board 10 can be approximately divided into a front footrest 12 and a rear footrest 14 connected with the front footrest 12. The front and rear footrests 12 and 14 are adapted for a user to stand with both feet thereon respectively, so that the user can use the shifting of the weight thereof or the driving of the force of both feet thereof to make the front and rear footrests 12 and 14 twist and deform in opposite directions around the major axis X-X'. The front steering device 20 and the rear steering device 40 are respectively disposed on the front section and the rear section of the bottom surface of the board 10 along the major axis X-X'.

Referring to FIGS. 1-3, 6 and 8, the rear steering device 40 includes a steering bearing 16, a rear wheel seat 42, a restoring unit 70, a rear wheel rack 44, a rear main pin 46, and two rear wheels 48.

The rear wheel seat 42 includes a top cap 422 and a main body 424. The top cap 422 of the rear wheel seat 42 and the steering bearing 16 are disposed on the bottom surface of the rear footrest 14 of the board 10 through a rear steering shaft 60 and a threaded fastener 76. The axis of the rear steering shaft 60 is defined as a first rotation axis 62, and the first rotation axis 62 is provided in a way that it inclines downwards from front to rear. Because the steering bearing 16 is disposed between the rear wheel seat 42 and the bottom surface of the rear footrest 14, the rear wheel seat 42 is rotatable relative to the bottom surface of the board 10 around the first rotation axis 62.

The rear main pin 46 includes a rear pin rod 462, a top shock absorber 464 and a bottom shock absorber 466. The axis of the rear pin rod 462 is defined as a rear main axis 468. The rear pin rod 462 is inserted through the bottom shock absorber 466, the rear wheel rack 44 and the top shock absorber 464 one by one and at last connected with the main body 424 of the rear wheel seat 42. Through the disposal of the top shock absorber 464, the rear wheel rack 44 is rotatable or swingable relative to the rear wheel seat 42 around the rear main axis 468. The top and bottom shock absorbers 464 and 466 are composed of elastomers made of elastic material such as synthetic rubber, for providing the rear wheel rack 44 elastic supporting relative to the rear wheel seat 42. A rear abutted surface 426 is defined where the rear wheel seat 42 and the rear wheel rack 44 are abutted against each other. For the major axis X-X', specifically speaking, on an imaginary vertical plane including the major axis X-X', the position X1 where the first rotation axis 62 passes the rear abutted surface 426 is in front of the position X2 where the rear main axis 468 passes the rear abutted surface 426. The rear wheel rack 44 is provided with a pivot 444. The pivot 444 is embedded in a pivot ring 428 of the rear wheel seat 42. The rear wheel rack 44 is provided with an axle 442. The two rear wheels 48 are pivotably disposed on two ends of the axle 442 respectively.

There is a first included angle θ1 between the first rotation axis 62 and the horizontal plane. There is a second included angle θ2 between the rear main axis 468 and the horizontal plane. The first included angle θ1 is larger than the second included angle θ2. In this way, the skateboard is relatively better in operational smoothness. Preferably, if the angular difference between the first included angle θ1 and the second included angle θ2 is ranged from 15 to 30 degrees, the skateboard 1 of this embodiment is further enhanced in operationality.

Referring to FIGS. 6, 8, 9 and 10, the restoring unit 70 is disposed between the board 10 and the rear wheel seat 42 for providing the rear wheel seat 42 a restoring force when the rear wheel seat 42 rotates relative to the board 10. In this embodiment, the main body 424 and top cap 422 of the rear wheel seat 42 define an accommodating space 429. The restoring unit 70 is disposed in the accommodating space 429. The restoring unit 70 includes a spring cover 72, a restoring spring 74, and the threaded fastener 76. The spring cover 72 has a protrusion 722 extending upwards parallel to the first rotation axis 62, and a stopping portion 724 extending downwards parallel to the first rotation axis 62. The spring cover 72 is fixedly embedded into the bottom end of the rear steering shaft 60 through the protrusion 722 in a way that the spring cover 72, the rear steering shaft 60 and the board 10 are disabled from relative rotation. The restoring spring 74 in this embodiment is a torsion spring. Two ends of the restoring spring 74 are formed as two protruding rods 742 extending perpendicularly to the first rotation axis 62 outwardly. The stopping portion 724 of the spring cover 72 is located between the two protruding rods 742. The threaded fastener 76 is inserted through the restoring spring 74 and the spring cover 72, and an end of the threaded fastener 76 is screwed into the rear steering shaft 60. Besides, the top cap 422 of the rear wheel seat 42 has a pushing portion 43 extending parallel to the first rotation axis 62 downwardly. The pushing portion 43 is located between the two protruding rods 742 of the restoring spring 74.

As a result, when the rear wheel seat 42 rotates relative to the board 10, the stopping portion 724 of the spring cover 72 is disabled from relative rotation along with the rear wheel seat 42 by that the protrusion 722 of the spring cover 72 is embedded in the rear steering shaft 60, but the pushing portion 43 of the top cap 422 of the rear wheel seat 42 rotates along with the rear wheel seat 42. Because both the stopping portion 724 and the pushing portion 43 are disposed between the two protruding rods 742 of the restoring spring 74, along with the gradually increasing angle for which the rear wheel seat 42 rotates relative to the board 10, one of the two protruding rods 742 is gradually moved away from the stopping portion 724 of the spring cover 72 by the pushing portion 43 of the top cap 422, and the other of the two protruding rods 742 will be abutted against the stopping portion 724, so that the restoring spring 74 stores up elastic restoring force for restoring the rear wheel seat 42 and the board 10 to the initial state.

The front steering device 20 is approximately the same in structure with the rear steering device 40, but the primary difference therebetween is that the front steering device 20 includes no such restoring unit 70. The detailed structure of the front steering device 20 is described hereunder.

Referring to FIGS. 1-3, 5 and 7, the front steering device 20 includes a steering bearing 18, a front wheel seat 22, a front wheel rack 24, a front main pin 26, and two front wheels 28.

The front wheel seat 22 includes a top cap 222 and a main body 224. The top cap 222 of the front wheel seat 22 and the steering bearing 18 are disposed on the bottom surface of the front footrest 12 of the board 10 through a front steering shaft 50 and a threaded fastener 78. The axis of the front steering shaft 50 is defined as a second rotation axis 52, and the second rotation axis 52 is provided in a way that it inclines downwards from front to rear. Because the steering bearing 18 is disposed between the front wheel seat 22 and the bottom surface of the front footrest 12, the front wheel seat 22 is rotatable relative to the bottom surface of the board 10 around the second rotation axis 52.

The front main pin 26 includes a front pin rod 262, a top shock absorber 264 and a bottom shock absorber 266. The axis of the front pin rod 262 is defined as a front main axis 268. The front pin rod 262 is inserted through the bottom shock absorber 266, the front wheel rack 24 and the top shock absorber 264 one by one and at last connected with the main body 224 of the front wheel seat 22. Through the disposal of the top shock absorber 264, the front wheel rack 24 is rotatable or swingable relative to the front wheel seat 22 around the front main axis 268. The top and bottom shock absorbers 264 and 266 are composed of elastomers made of elastic material such as synthetic rubber, for providing the front wheel rack 24 elastic supporting relative to the front wheel seat 22. A front abutted surface 226 is defined where the front wheel seat 22 and the front wheel rack 24 are abutted against each other. For the major axis X-X', specifically speaking, on an imaginary vertical plane including the major axis X-X', the position X3 where the second rotation axis 52 passes the front abutted surface 226 is in front of the position X4 where the front main axis 268 passes the front abutted surface 226. The front wheel rack 24 is provided with a pivot 244. The pivot 244 is embedded in a pivot ring 228 of the front wheel seat 22. The front wheel rack 24 is provided with an axle 242. The two front wheels 28 are pivotably disposed on two ends of the axle 242 respectively.

There is a third included angle θ3 between the second rotation axis 52 and the horizontal plane. There is a fourth included angle θ4 between the front main axis 268 and the horizontal plane. The third included angle θ3 is larger than the fourth included angle θ4. In this way, the skateboard is relatively better in operational smoothness. Preferably, if the angular difference between the third included angle θ3 and the fourth included angle θ4 is ranged from 15 to 30 degrees, the skateboard 1 of this embodiment is further enhanced in operationality.

It should be additionally mentioned that for this embodiment, the rear steering device 40 may include no such restoring unit 70, and in such case the rear steering device is like the front steering device to rotate smoothly and freely so that the operationality is further enhanced. Compared with the skateboard with the restoring unit, the skateboard with no such restoring unit is reduced in radius of gyration when advancing, that means the skateboard can attain the effect of small turn. Correspondingly, in other potential embodiments, the front steering device 20 may include the restoring unit 70 (not shown). Alternatively, the front steering device 20 and the rear steering device 40 may both include the restoring unit 70 (not shown).

Besides, although the detailed structures of the front steering device 20 and the rear steering device 40 are described in this embodiment, but in other potential embodiments, they are unlimited thereto in practical applications. For example, in this embodiment the rear steering device 40 may have the afore-described structure, but the front steering device 20 may have the structure widely used in the conventional skateboard with a normal board and four wheels, such as the structure disclosed in Patent Publication No. U.S. Pat. No. 6,547,262B1 mentioned in the description of the related art.

Through the afore-described structure, when the user uses the skateboard 1 of this embodiment, the user uses the shifting of the weight thereof or the driving of the force of both feet thereof to make the board 10 twist and deform in opposite directions around the major axis X-X'. Because each of the front steering device 20 and the rear steering device 40 has two wheels, the skateboard 1 of this embodiment is relatively better in operational stability. Besides, on the imaginary vertical plane including the major axis X-X', the position where the first rotation axis 62 passes the rear abutted surface 426 is in front of the position where the rear main axis 468 passes the rear abutted surface 426, so the board 10 will firstly transmit the force applied by the user to the rear wheel seat 42 of the rear steering device 40 to drive the rear wheel seat 42 to rotate relative to the board 10, and then the rear wheel seat 42 will further drive the rear wheel rack 44 to rotate relative to the rear wheel seat 42. Because the rear wheel rack 44 will rotate after the rear wheel seat 42 is driven to rotate, the force applied by the user will not be counteracted by the rear wheel rack 44 firstly. In addition, the rear wheel seat 42 and the rear wheel rack 44 are both rotatable relative to the board 10, so the skateboard 1 has relatively better performance in operational smoothness in advancing. Because the operating theorem and effect of the front steering device 20 are approximately the same with those of the rear steering device 40, that will not be repeatedly mentioned hereunder.

Referring to FIGS. 11-19, a skateboard 10A of another embodiment of the present invention includes a board 20A, a first fastening unit 50A, a second fastening unit 60A, a front steering device 70A, and a rear steering device 80A. The front steering device 70A and the rear steering device 80A are fastened to the bottom surface of the board 20A by the first and second fastening units 50A and 60A respectively.

Figure 11:
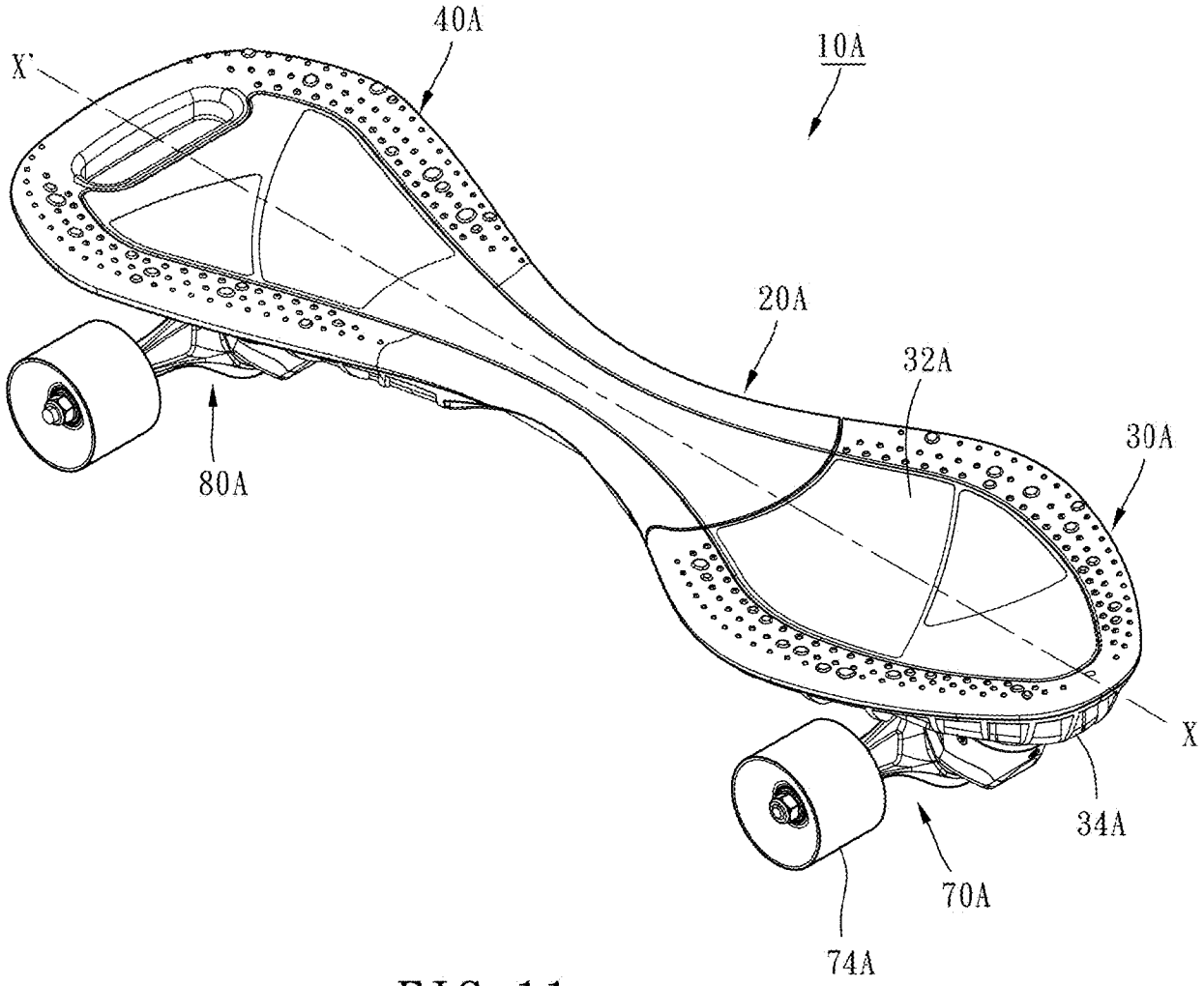
FIG. 11 is a perspective view of another embodiment of the present invention.
Figure 12:
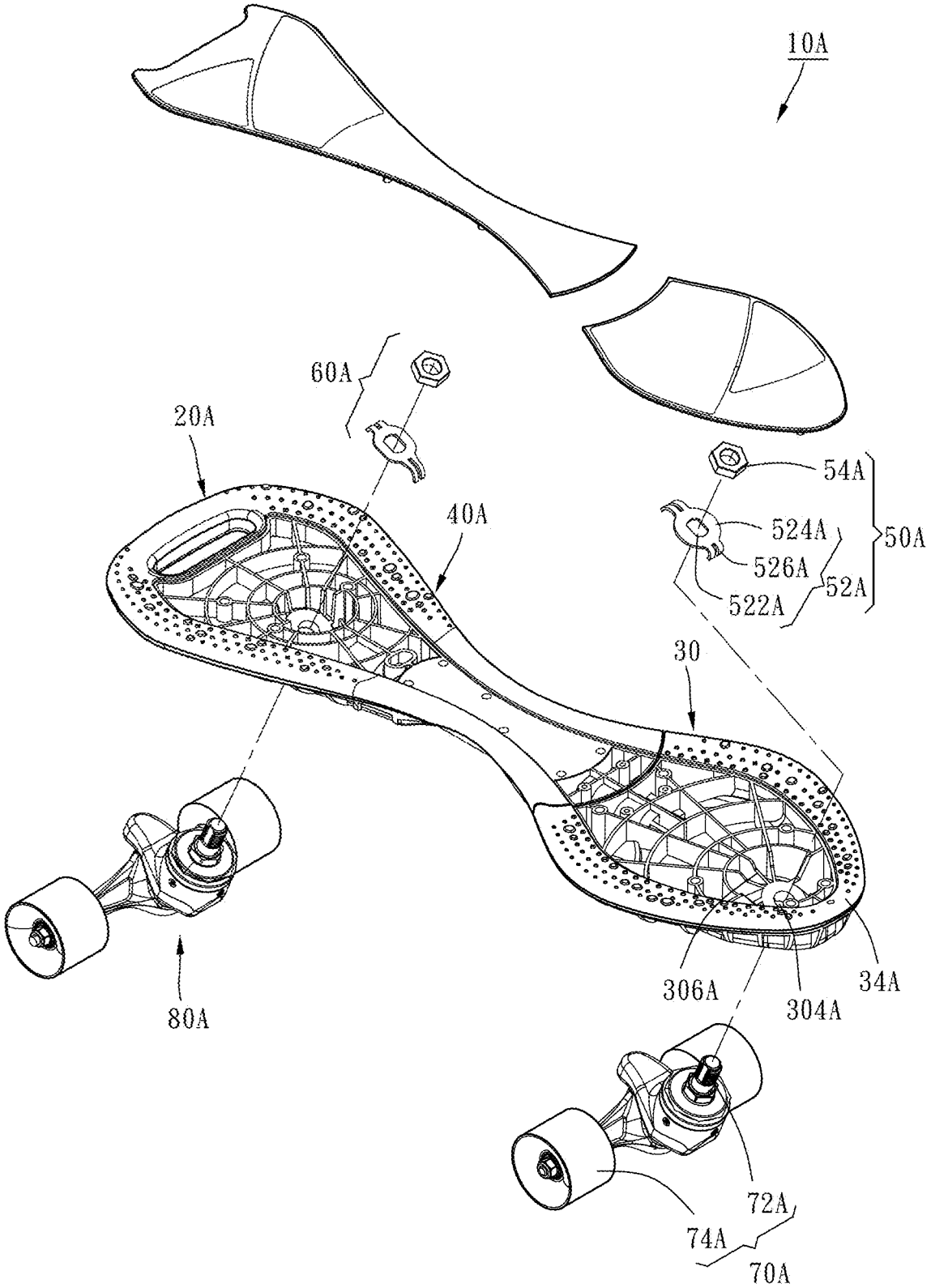
FIG. 12 is an exploded perspective view of said another embodiment of the present invention.
Figure 13:
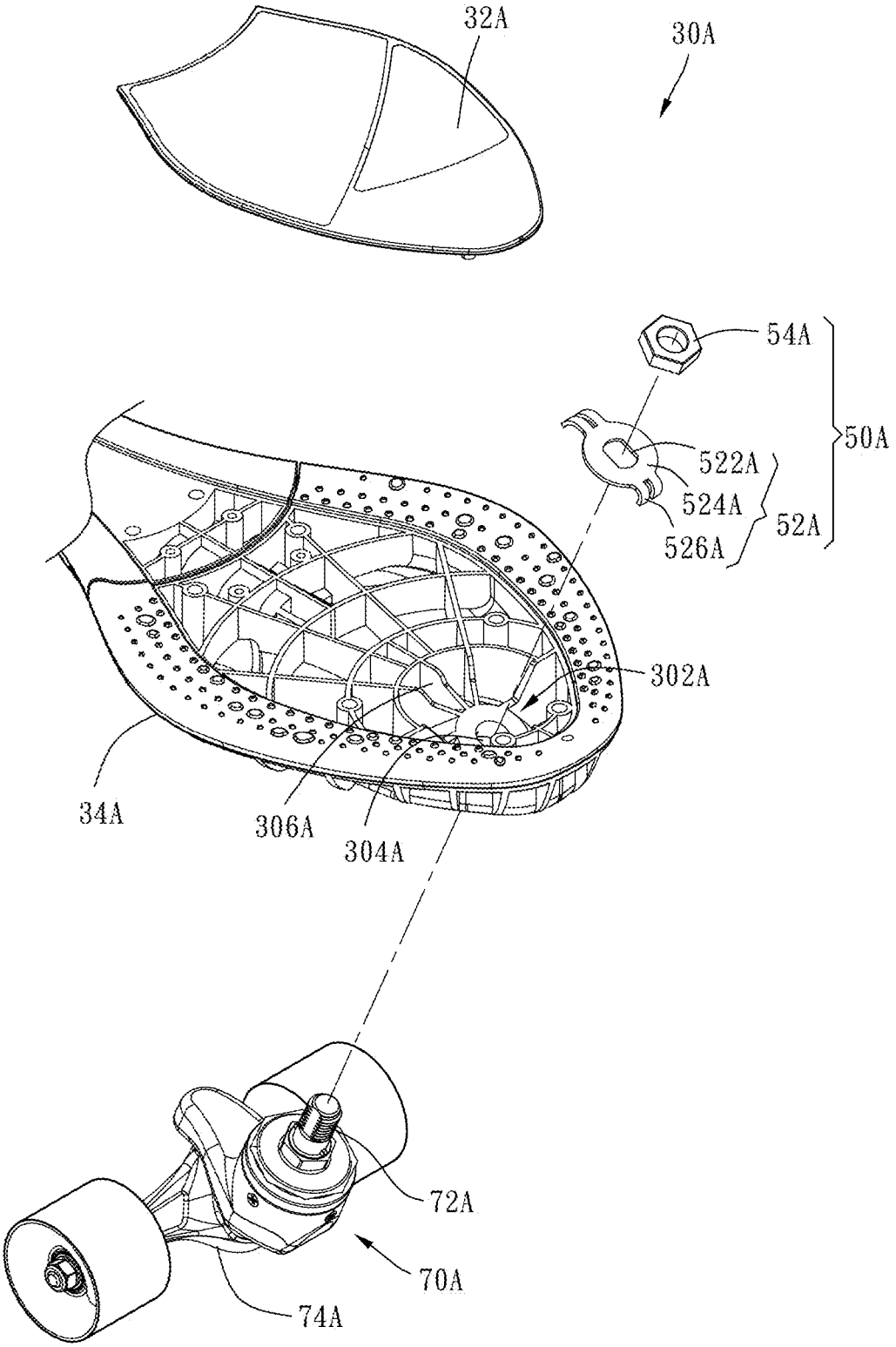
FIG. 13 is a partially exploded perspective view of said another embodiment of the present invention, primarily showing the connecting relation between a front footrest, a front steering device and a first fastening unit.
Figure 14:
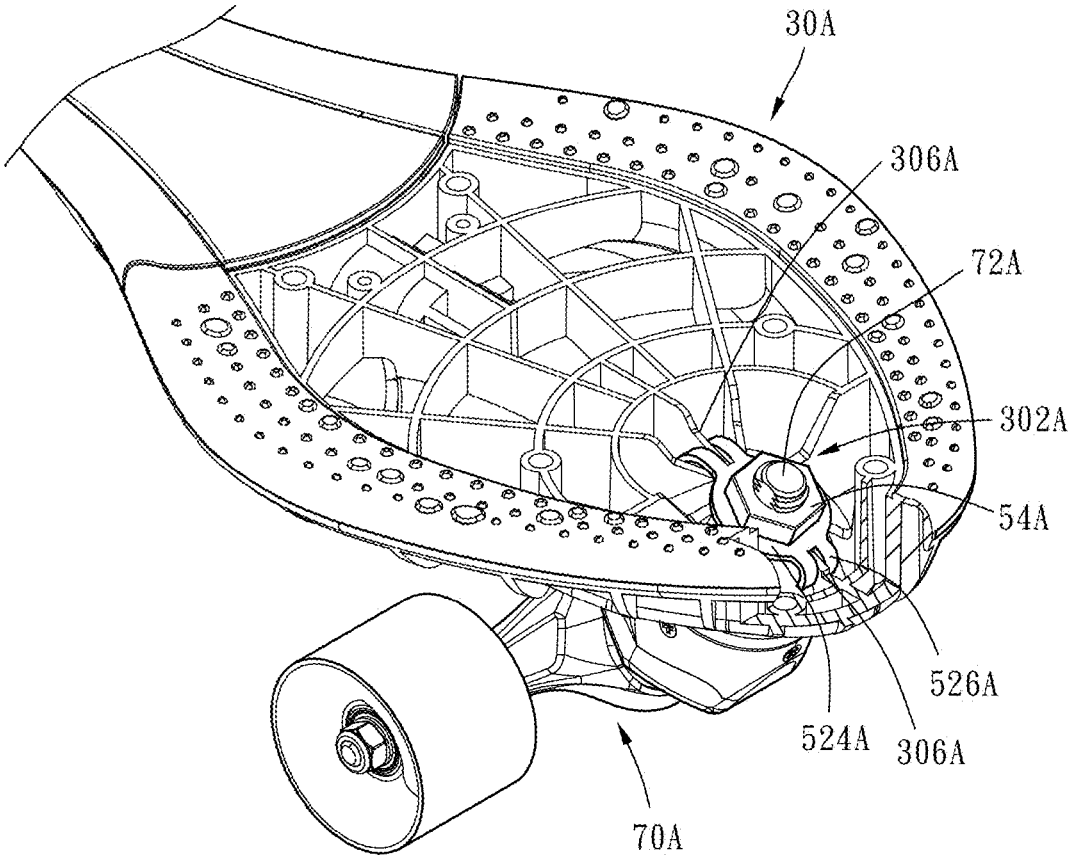
FIG. 14 is similar to FIG. 13, primarily showing the connecting relation between the front footrest, the front steering device and the first fastening unit when they are assembled.
Figure 15:
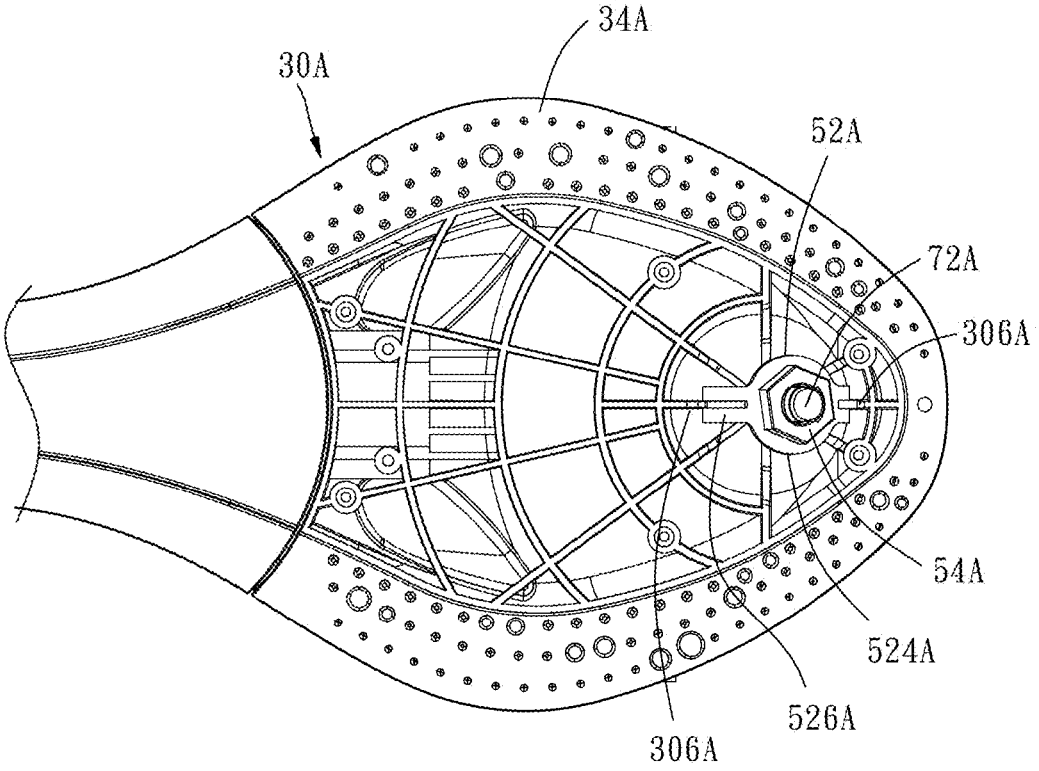
FIG. 15 is a partially sectional top view of said another embodiment of the present invention, primarily showing the connecting relation between the front footrest and the first fastening unit.

Referring to FIG. 11, the board 20A is made of elastic material which may be optionally, but unlimited to, resin or composite material mixed with resin. The board 20A is approximately shaped as an elongated board and has a major axis X-X'. In this embodiment, the board 20A can be approximately divided into a front footrest 30A and a rear footrest 40A connected with the front footrest 30A. The front and rear footrests 30A and 40A are adapted for a user to stand with both feet thereon respectively, so that the user can use the shifting of the weight thereof or the driving of the force of both feet thereof to make the front and rear footrests 30A and 40A twist and deform in opposite directions around the major axis X-X'. The front steering device 70A and the rear steering device 80A are respectively disposed on the bottom surfaces of the front footrest 30A and the rear footrest 40A of the board 20A along the major axis X-X'.

Referring to FIGS. 11-15, the front footrest 30A of the board 20A is composed of a first covering plate 32A and a first base 34A connected with and located under the first covering plate 32A. The front footrest 30A of the board 20A includes an accommodating space 302A, a through hole 304A and a plurality of limiting ribs 306A. The accommodating space 302A is formed between the first covering plate 32A and the first base 34A. The through hole 304A is opened on the bottom surface of the first base 34A of the front footrest 30A, and communicates with the accommodating space 302A and the outside of the first base 34A of the board 20A. The plurality of limiting ribs 306A are formed in the first base 34A of the board 20A, located around the accommodating space 302A, and extend radially from the periphery of the through hole 304A.

The front steering device 70A includes a front steering shaft 72A and a front wheel unit 74A. The bottom end of the front steering shaft 72A is fixed to the front wheel unit 74A. The front wheel unit 74A may, but unlimited to, include two wheels. In other potential embodiments, the front wheel unit may include only one wheel or at least three wheels. The top end of the front steering shaft 72A is inserted into the accommodating space 302A through the through hole 304A of the front footrest 30A of the board 20A.

Figure 17:
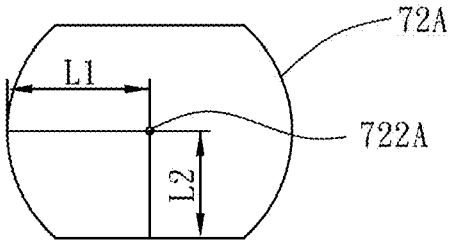
FIG. 17 is a schematic view of a cross section of a steering shaft of said another embodiment of the present invention.
Figure 18:
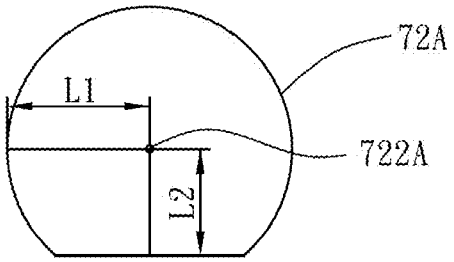
FIG. 18 is similar to FIG. 17, primarily showing a schematic view of a cross section of another type of steering shaft.
Figure 19:
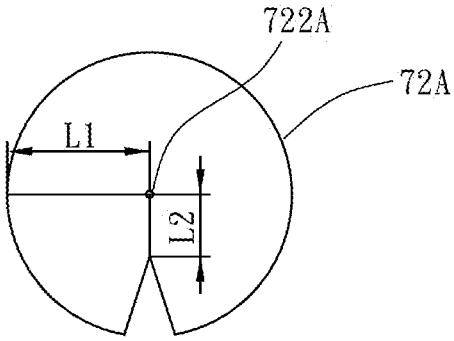
FIG. 19 is similar to FIG. 17, primarily showing a schematic view of a cross section of still another type of steering shaft.

Besides, referring to FIGS. 13-15 and 17, the distance L1 from the second rotation axis 722A on the cross section of the front steering shaft 72A to a point of the outline of the cross section is unequal to the distance L2 from the second rotation axis 722A to another point of the outline. As shown in FIGS. 17-19, the cross section of the front steering shaft 72A in this embodiment is shaped as a circle with two opposite cuts as shown in FIG. 17, but unlimited thereto in practice. In other potential embodiments, the cross section of the front steering shaft 72A may be shaped as a circle with only one cut as shown in FIG. 18. Alternatively, as shown in FIG. 19, the cut may be indented from the periphery of the circle toward the second rotation axis 722A.

Referring to FIGS. 12-15, the first fastening unit 50A includes a limiting spacer 52A and a nut 54A. The limiting spacer 52A is unrotatably engaged with the board 20A and provided with a limiting hole 522A. The front steering shaft 72A is inserted through the through hole 304A and the limiting hole 522A of the limiting spacer 52A, and an interference fit is provided between the inner contour of the limiting hole 522A and the outer contour of the front steering shaft 72A, so that the limiting spacer 52A is disabled from rotating relative to the front steering shaft 72A. The nut 54A is screwed onto the front steering shaft 72A. The limiting spacer 52A is located between the board 20A and the nut 54A.

In this embodiment, the limiting spacer 52A is made of metal and disposed in the accommodating space 302A, and the limiting hole 522A is shaped correspondingly to the outer contour of the front steering shaft 72A. In other words, no matter what shape the cross section of the front steering shaft 72A is, the limiting hole 522A of the limiting spacer 52A is shaped correspondingly thereto, so that an interference fit is provided between the inner contour of the limiting hole 522A and the outer contour of the front steering shaft 72A, disabling the limiting spacer 52A from rotating relative to the front steering shaft 72A. Besides, the limiting spacer 52A has a main body 524A and two ear portions 526A. The limiting hole 522A penetrates through the main body 524A. The ear portions 526A extend out from the main body 524A and arranged symmetrically. Each of the ear portions 526A is engaged on one of the limiting ribs 306A, so that the limiting spacer 52A is disabled from rotating relative to the first base 34A of the board 20A.

It should be additionally remarked that the limiting spacer 52A is unlimited to have two ear portions 526A, and there is unlimited a plurality of limiting ribs 306A. In other potential embodiments, there may be only one ear portion and only one limiting rib (not shown), as long as the ear portion of the limiting spacer can be correspondingly engaged with the limiting rib to disable the limiting spacer from rotating relative to the first base of the board.

Figure 16:
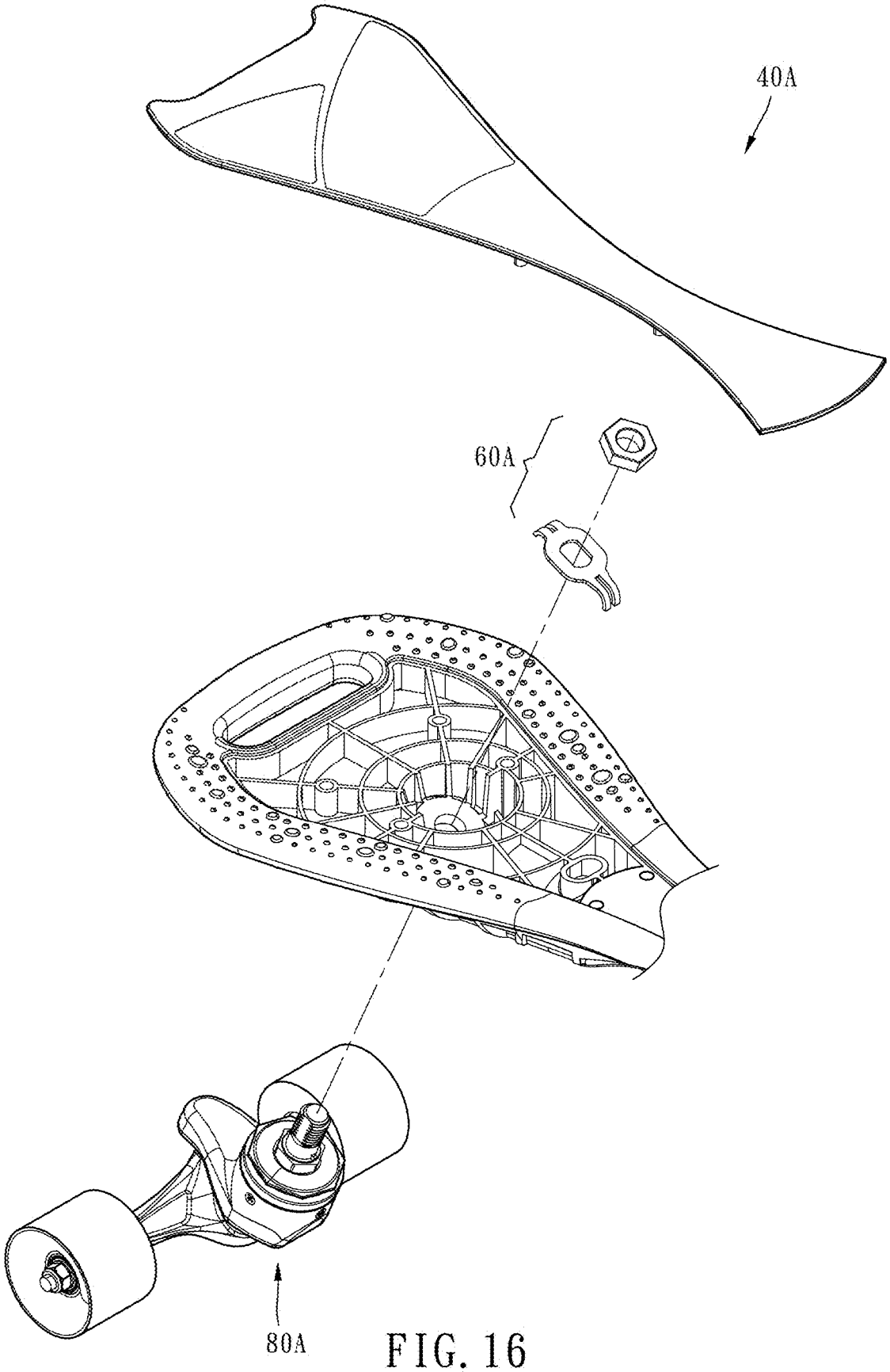
FIG. 16 is a partially exploded perspective view of said another embodiment of the present invention, primarily showing the connecting relation between a rear footrest, a rear steering device and a second fastening unit.

The above description is about the connecting relation and fastening manner of the board 20A, the first fastening unit 50A and the front steering device 70A. Because the connecting relation between the board 20A, the second fastening unit 60A and the rear steering device 80A as shown in FIG. 16 is the same with the connecting relation between the board 20A, the first fastening unit 50A and the front steering device 70A, the part about the board 20A, the second fastening unit 60A and the rear steering device 80A will not be repeatedly mentioned.

It should be additionally remarked that in other potential embodiments, not all of the steering devices of the skateboard should be fastened to the board in the fastening manner disclosed in this embodiment. In other words, there may be partial steering device using the fastening manner of this embodiment. For example, the skateboard can use the fastening manner of this embodiment on only the rear steering device, but use another fastening manner on the front steering device. Likewise, the skateboard can use the fastening manner of this embodiment on only the front steering device, but use another fastening manner on the rear steering device.

In conclusion, the skateboard 10A of this embodiment has at least the following advantages:

1. Through the manner that the ear portion 526A of the limiting spacer 52A is engaged with the limiting rib 306A of the board 20A, when the skateboard 10A of this embodiment is in use, it is prevented from the condition that the limiting spacer 52A rotates relative to the board 20A, so that the looseness of the nut is reduced.

2. Through the connecting relation that an interference fit is provided between the inner contour of the limiting spacer 52A and the outer contour of the front steering shaft 72A, when the skateboard 10A of this embodiment is in use, it is prevented from the condition that the front steering shaft 72A rotates relative to the limiting spacer 52A and the board 20A, so that the looseness of the nut is reduced.

3. Through the cooperation of the above two advantages, the fastening strength and durability of the steering device and the board are effectively raised, lowering the risk of the skateboard getting out of control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A skateboard, which is characterized in that the skateboard comprises:

a board, a front steering device and a rear steering device;

the board has a major axis; the front steering device and the rear steering device are respectively disposed on a front section and a rear section of a bottom surface of the board along the major axis; each of the front steering device and the rear steering device has two wheels; the board is adapted for a user to stand with both feet on the board;

at least one of the front steering device and the rear steering device has a wheel seat and a wheel rack; the wheel seat is disposed on the bottom surface of the board rotatably around a rotation axis which inclines downwards from front to rear; the wheel rack is disposed on the wheel seat rotatably or swingably around a main axis; an abutted surface is defined where the wheel seat and the wheel rack are abutted against each other; on an imaginary vertical plane comprising the major axis, a position where the rotation axis passes the abutted surface is in front of another position where the main axis passes the abutted surface.

2. The skateboard as claimed in claim 1, which is characterized in that an included angle between the rotation axis and a horizontal plane is larger than another included angle between the main axis and the horizontal plane.

3. The skateboard as claimed in claim 2, which is characterized in that an angular difference between the included angle between the rotation axis and the horizontal plane and the included angle between the main axis and the horizontal plane is ranged from 15 to 30 degrees.

4. The skateboard as claimed in claim 1, which is characterized in that a shock absorber is disposed between the wheel rack and the wheel seat for actuating the wheel rack to rotate or swing relative to the wheel seat.

5. The skateboard as claimed in claim 1, which is characterized in that the skateboard comprises a restoring unit; the restoring unit is disposed between the board and the wheel seat for providing the wheel seat a restoring force when the wheel seat rotates relative to the board.

6. The skateboard as claimed in claim 5, which is characterized in that the wheel seat comprises a top cap and a main body; the main body and the top cap define an accommodating space; the restoring unit is disposed in the accommodating space.

7. The skateboard as claimed in claim 6, which is characterized in that the restoring unit comprises a spring cover and a restoring spring; the spring cover is fixed to the bottom surface of the board and provided with a stopping portion extending parallel to the rotation axis; the restoring spring has two protruding rods extending perpendicularly to the rotation axis; the stopping portion is located between the two protruding rods.

8. The skateboard as claimed in claim 7, which is characterized in that the top cap has a pushing portion extending parallel to the rotation axis; the pushing portion is located between the two protruding rods.

9. The skateboard as claimed in claim 1, which is characterized in that at least one of the front steering device and the rear steering device is fastened to the bottom surface of the board by a fastening unit and comprises a steering shaft; the fastening unit comprises a limiting spacer and a nut; the limiting spacer is unrotatably engaged with the board and provided with a limiting hole; the steering shaft is inserted through a through hole opened on the bottom surface of the board and the limiting hole of the limiting spacer, and an interference fit is provided between an inner contour of the limiting hole and an outer contour of the steering shaft, so that the limiting spacer is disabled from rotating relative to the steering shaft; the nut is screwed onto the steering shaft; the limiting spacer is located between the board and the nut.

10. The skateboard as claimed in claim 9, wherein a distance from the rotation axis on a cross section of the steering shaft to a point of an outline of the cross section is unequal to another distance from the rotation axis to another point of the outline.

11. The skateboard as claimed in claim 10, wherein the limiting hole is shaped correspondingly to the outer contour of the steering shaft.

12. The skateboard as claimed in claim 11, wherein the cross section of the steering shaft is shaped as a circle with a cut.

13. The skateboard as claimed in claim 12, wherein the cut is indented from a periphery of the circle toward the rotation axis.

14. The skateboard as claimed in claim 9, wherein the board comprises an accommodating space; the through hole communicates with the accommodating space and an outside of the board; the limiting spacer is disposed in the accommodating space.

15. The skateboard as claimed in claim 9, wherein the limiting spacer has a main body and an ear portion; the limiting hole penetrates through the main body; the ear portion extends out from the main body.

16. The skateboard as claimed in claim 15, wherein the board has a limiting rib; the ear portion of the limiting spacer is engaged with the limiting rib to disable the limiting spacer from rotating relative to the board.

17. The skateboard as claimed in claim 16, wherein the limiting spacer has two said ear portions arranged symmetrically; the board has two said limiting ribs; the ear portions are engaged with the limiting ribs respectively.

* * * * *